US005491896A

United States Patent [19]

Stolzer et al.

[11] Patent Number: 5,491,896

[45] Date of Patent: Feb. 20, 1996

[54] ATTACHMENT AND ACCESSORY SCRAPER BLADES FOR DETAIL SANDER

[75] Inventors: J. Timothy Stolzer, Pickens; Robert McCracken, Easley, both of S.C.

[73] Assignee: Ryobi Motor Products, Easley, S.C.

[21] Appl. No.: 169,773

[22] Filed: Dec. 17, 1993

[51] Int. Cl.[6] ..... B26B 7/00

[52] U.S. Cl. ..... 30/169; 15/236.01

[58] Field of Search ..... 30/169; 51/170 R, 51/170 MT, 170 PT, 170 T; 15/93.1, 236.01, 236.07; 451/162, 163

[56] References Cited

U.S. PATENT DOCUMENTS

| | | | |
|---|---|---|---|
| 455,129 | 6/1891 | Staehlin | 30/169 X |
| 2,350,098 | 5/1944 | Decker . | |
| 2,599,193 | 6/1952 | Morris | 30/169 |
| 2,734,139 | 2/1956 | Murphy . | |
| 2,836,940 | 6/1958 | Carmichael . | |
| 3,190,045 | 6/1965 | Zuzelo . | |
| 3,530,577 | 9/1970 | Franklin et al. | 30/169 |
| 4,024,672 | 5/1977 | Wieck . | |
| 4,823,514 | 4/1989 | DeLuca . | |
| 4,829,719 | 5/1989 | Braselton . | |
| 4,920,702 | 5/1990 | Kloss et al. . | |
| 5,123,216 | 6/1992 | Kolls et al. . | |
| 5,309,598 | 3/1994 | Carpenter | 30/169 X |

FOREIGN PATENT DOCUMENTS

| | | |
|---|---|---|
| 38409974 | 6/1990 | Germany . |

*Primary Examiner*—Douglas D. Watts
*Attorney, Agent, or Firm*—Brooks & Kushman

[57] ABSTRACT

A detail sander having a scraper blade of a shape that allows for different geometric configurations to be oriented into the working position to contact a work surface. Blades may also be adjusted forward or rearward relative to the leg of the sander to allow for changes in the stroke of the sweeping motion produced by the sander. A teardrop shaped blade and a triangular shaped blade having varying geometries about their respective peripheries allow for varying tip geometries to be oriented into the working position of the blade. Additionally, the blades are removable so that different blades may be attached to suit different needs.

9 Claims, 3 Drawing Sheets

ATTACHMENT AND ACCESSORY SCRAPER BLADES FOR DETAIL SANDER

TECHNICAL FIELD

This invention relates to sanding tools and more particularly to detail sanders.

BACKGROUND ART

Detail sanders are used for performing specific finishing tasks such as sanding edges adjacent to internal walls and use in other difficult to reach areas. To perform such tasks, the tools utilized must be able to have controlled finite movement in a confined area so as to fine sand the desired area without damaging the surface upon which the work is being performed. Various approaches have been taken to perform the difficult task of sanding these internal corners and other hard to reach areas which require fine sanding or abrasion.

However, these approaches have used a limited amount of variation of the shapes and contours of the blades. Thus, while the tools can reach into some desired areas, the proper blade action and surface contact with the working surface may not be had.

The present invention incorporates many of the known benefits of detail sanders while improving the ability of the operator to utilize the various geometric shapes and contours of blades to accomplish the task more satisfactorily.

DISCLOSURE OF INVENTION

It is an object of the present invention to provide a detail sander with a blade that can assume various orientations relative to the sander and has varied geometry around its periphery to allow the various geometry to be in the working position relative to the sander.

It is a further object of the present invention to provide a detail sander with a variety of removable blades having varying peripheral geometries to suit different tasks.

Accordingly, a detail sander is provided having a scraper blade of a shape that allows for different geometric configurations to be oriented into the working position to contact a work surface. The blade can also be adjusted forward or rearward relative to the leg of the sander to allow for changes in the stroke of the sweeping motion produced by the sander. A teardrop shaped blade and a triangular shaped blade having varying geometry about their respective peripheries allow for varying tip geometries to be oriented into the working position of the blade.

The foregoing and other objects, features and advantages of the present invention are readily apparent from the following detailed description of the best mode for carrying out the invention when taken in connection with the accompanying drawings.

BEST MODES FOR CARRYING OUT THE INVENTION

Figure 1:
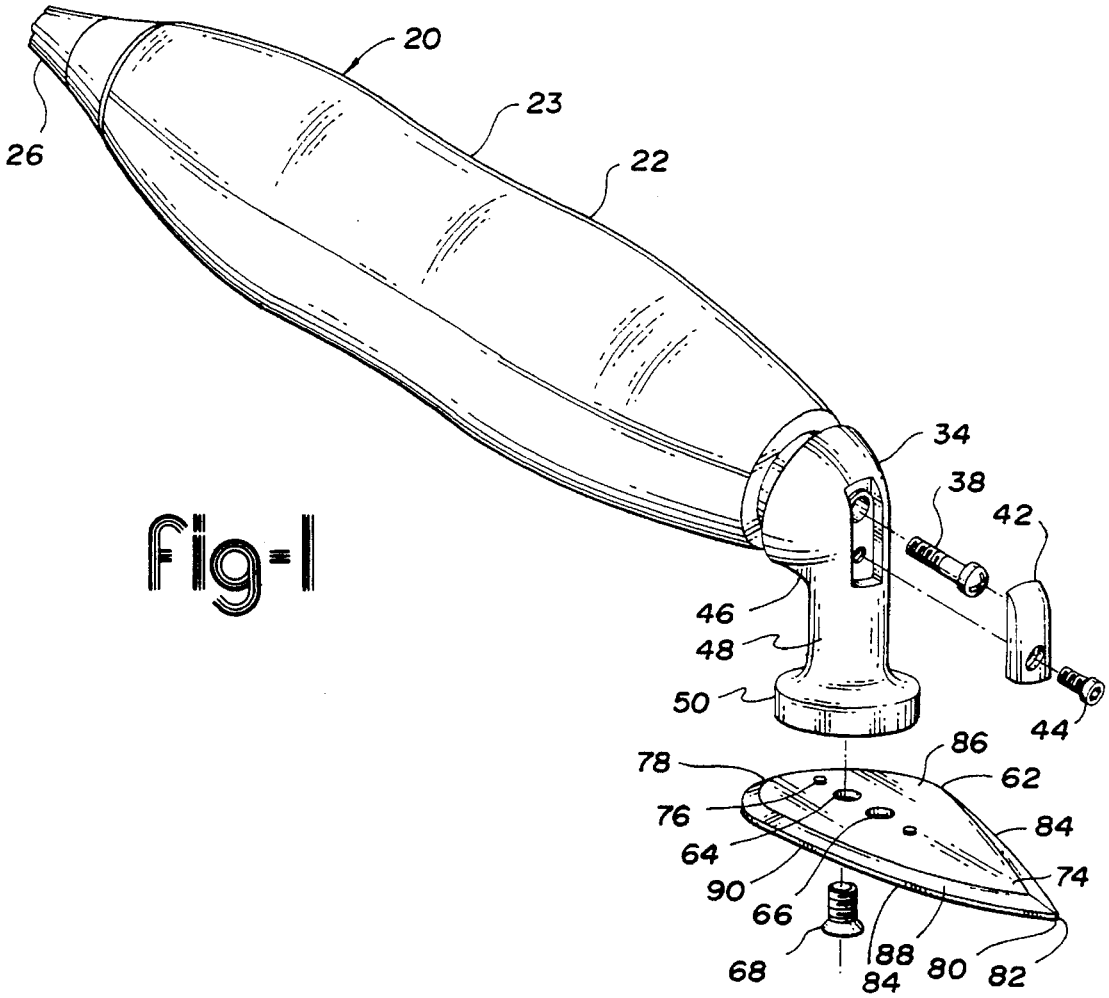
FIG. 1 is a perspective, partially exploded, view of the overall detail sander in accordance with the present invention.
Figure 2:
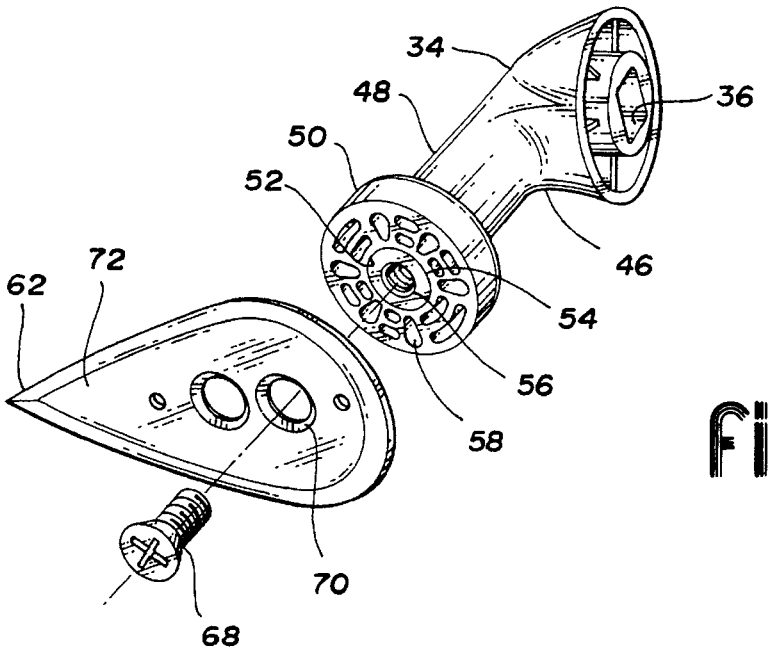
FIG. 2 is a perspective, exploded view of the leg and blade assembly in accordance with the present invention.
Figure 3:
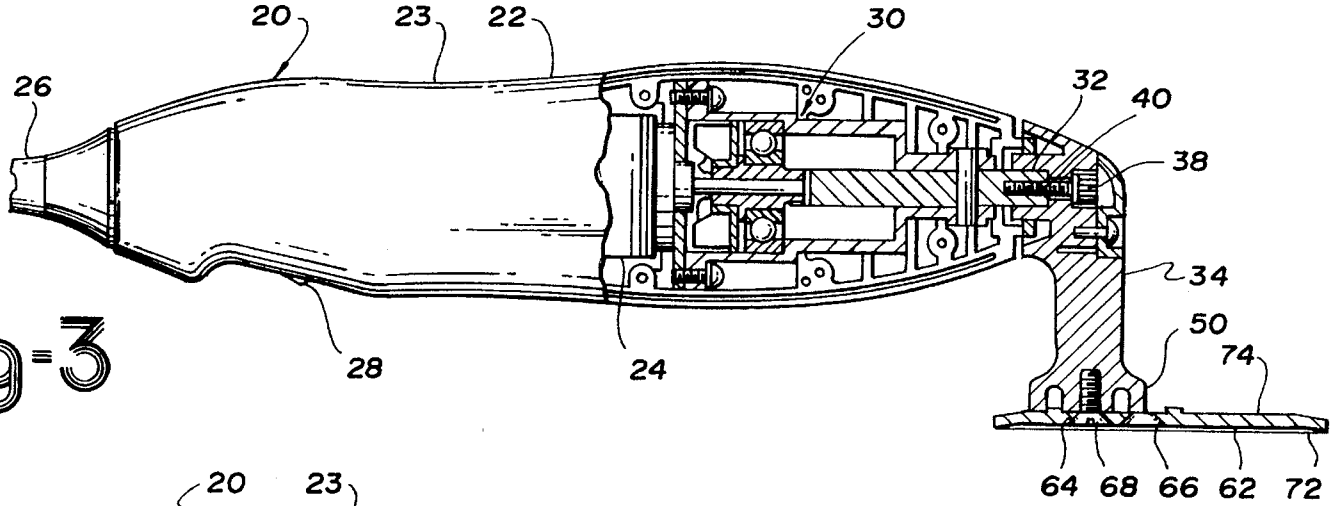
FIG. 3 is a side elevation view of the detail sander and blade partially broken away, in accordance with the present invention.

FIGS. 1 to 3 illustrate a detail sander 20 having a main body 22, including a grip portion 23. Within the main body is mounted a motor 24 electrically connected to a power cord 26. Power to the motor 24 can be turned on or off by a switch 28. Also mounted within the main body forward of and connected to the output of the motor 24, is an oscillation mechanism 30. When referring to forward and rearward herein, the rearward end is the end out of which the power cord 26 protrudes and the forward end is the end of the detail sander 20 where the working blades are located.

The oscillation mechanism 30 includes a lever arm 32 which is caused to pivot back and forth causing a oscillatory motion. A leg 34 is mounted to the lever arm 32 by sliding a bore 36 over the forward end of the lever arm 32 and installing a leg screw 38 into a screw hole 40 in the forward end of the lever arm 32. The head of the leg screw 38 can be covered by a leg cap 42 that is mounted to the leg 34 by a leg cap screw 44.

The leg 34 has a 90 degree bend 46 in it and a straight portion 48 to properly align and orient the scraper blade, described below, and to ensure that the operator's hand has room to grip the detail sander 20 above a work surface while in operation. At the opposite end of the straight portion 48 from the bend 46 is a foot portion 50. A bore 52 is provided in the bottom of the foot 50, and an insert 54, having a threaded mounting bore 56, is press fit into the bore 52. Also, provided within the bottom of the foot 50 are a plurality of alignment holes 58. In the embodiment shown, there are six alignment holes 58, located circumferentially around the bore 52. The holes 58 are oriented in three pairs that are located across the bore 52 from one another. The threaded mounting bore 56 and the alignment holes 58 cooperate to align and mount the scraper blades.

This leg design allows various blades to be removably mounted to the foot 50 and allows them to be oriented with different portions of a blade in the working position. The working position, as used herein, is the forwardmost portion of a blade when it is attached to the foot 50 of the sander 20. By varying the geometry of a blade about its periphery, different geometry can be oriented in the working position as described below.

A tear drop shaped blade 62 is illustrated in FIGS. 1 to 3. The blade includes a first mounting hole 64 spaced from a second mounting hole 66. The first and second mounting holes 64, 66 are sized to receive a blade mounting screw 68 that will thread into the threaded mounting bore 56 on the foot 50 of the leg 34. The first and second mounting holes 64, 66 each have a concentric countersink 70 on the bottom surface 72 in order to allow the blade mounting screw 68 to mount flush with the bottom surface 72 of the blade 62.

Protruding from the top surface 74 of the blade 62 are two alignment bosses 76 on either side of the first and second mounting holes 64, 66. The alignment bosses 76 are sized to fit within the alignment holes 58 on the foot 50 of the leg 34. The mounting holes 64, 66 and the alignment bosses 76 are oriented in a line, from a second end 80 toward a first end 78. They are spaced such that when one of the first or second mounting holes 64, 66 are aligned with the threaded mounting bore 56, one of the alignment bosses 76 will align with one of the alignment holes 58.

In this way, the blade 62 can be aligned more forward or more rearward relative to the leg 34 depending upon which mounting hole 64, 66 is aligned with the threaded mounting bore 56 when the blade 62 is mounted to the foot 50 when the blade mounting screw 68 is secured in place. Additionally, the blade 62 can be oriented rotationally relative to the leg 34 depending upon which alignment hole 58 one of the alignment bosses 76 is aligned with when the blade 62 is mounted. Various orientations of a blade, then, can be used to put different portions of the blade forward, effectively altering the geometry of the working position of the blade.

The overall shape of the tear drop blade 62 illustrated in FIGS. 1 to 3 and 6. It has a first end 78 that is semi-circular in shape and a second end 80 that forms a pointed tip 82. Starting at the tip 82 and expanding toward and blending into the semicircular shape of the first end 78 are two sides 84. The two sides 84 have a slight convex curvature to them, although more curvature or no curvature will also work depending upon the user's particular needs.

The varying shape of the blade 62, then, will allow it to be used for different needs of an operator of the sander 20. FIGS. 1 to 3 and 6 to 9 illustrate varying orientations of the blade 62. FIGS. 1 and 8 illustrate the blade 62 oriented with the tip 82 in the forwardmost, i.e., working, position. In this orientation, the narrow shape will allow the tool to be used in hard to reach and narrow locations and will allow an operator to concentrate the force applied to the sander 20 into a small surface area, thus increasing the pressure applied to the working surface. In FIG. 8, the blade 62 is placed further rearward relative to the leg 34 than in FIG. 1 and, consequently, will have a stroke with a smaller sweeping motion that the orientation of the blade in FIG. 1. In this way the operator can adjust the stroke for various uses.

Figure 7:
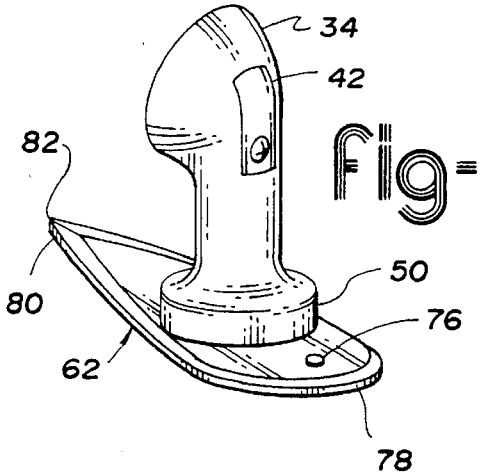
FIG. 7 is a perspective view of the teardrop blade and leg, showing a different orientation of the two, in accordance with the present invention.
Figure 8:
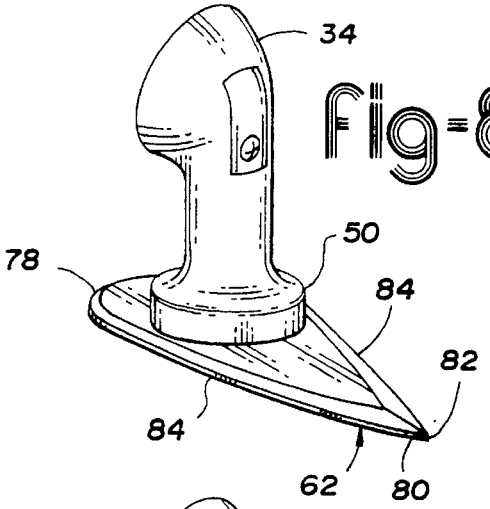
FIG. 8 is a perspective view of the teardrop blade and leg, showing a further orientation of the two, in accordance with the present invention.
Figure 9:
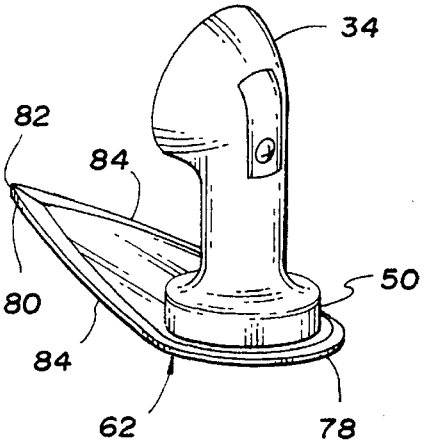
FIG. 9 is a perspective view of the teardrop blade and leg, showing a still further orientation of the two, in accordance with the present invention.

FIGS. 7 and 9 show the blade 62 with the first end 78 forward. This orientation can be used by the operator when the space for the working surface is not tight. A larger area, then, can be covered by the blade 62 than in the position described above. Also, the larger surface area will reduce the amount of pressure applied to the work piece for a given amount of force applied to the sander 20 by the operator relative to the second end 80 being forward. For example, the round end of the teardrop blade is better for use in burnishing a piece of leather since an increased surface area up front reduces the scraping pressure on the work piece. Again, the stroke can be adjusted by mounting the blade 62 further forward or rearward relative to the leg 34.

The top surface 74 and the bottom surface 72 of the blade are preferably formed from a flat piece of material having an edge at 90 degrees relative to the flat surfaces such that each has an inner surface 86 and an outer surface 88 at an angle relative to it. The two surfaces are preferably angled approximately 15–20 degrees relative to one another. This gives the bottom corner of a blade, referred to herein as a facet 90, an acute angle relative to the plane of the inner surface 86 will give the facet 90 a more crisp edge relative to the working surface rather than a flat blade with a bigger land.

By forming the blade 62 with a flat piece of material having 90 degree edges, the blade 62 can have this crisp edge and still avoid a knife edge that would be needed if the facet angle were cut into a flat piece of material. The advantage of this configuration, then, is that the blade won't wear as fast, will be safer for the operator to use without a knife edge and also the edge will be somewhat self-sharpening. Additionally, the blade will have less surface contact with the working surface. Allowing this forming with an angled surface allows take crisp edge all along the curves of the edges of this blade 62 without the necessity of cutting the 15 to 20 degree angle as separate step. This eliminates the difficulty of forming the angled surface along the edge that is not found with simpler and less versatile blades that have straight edges.

Figure 4:
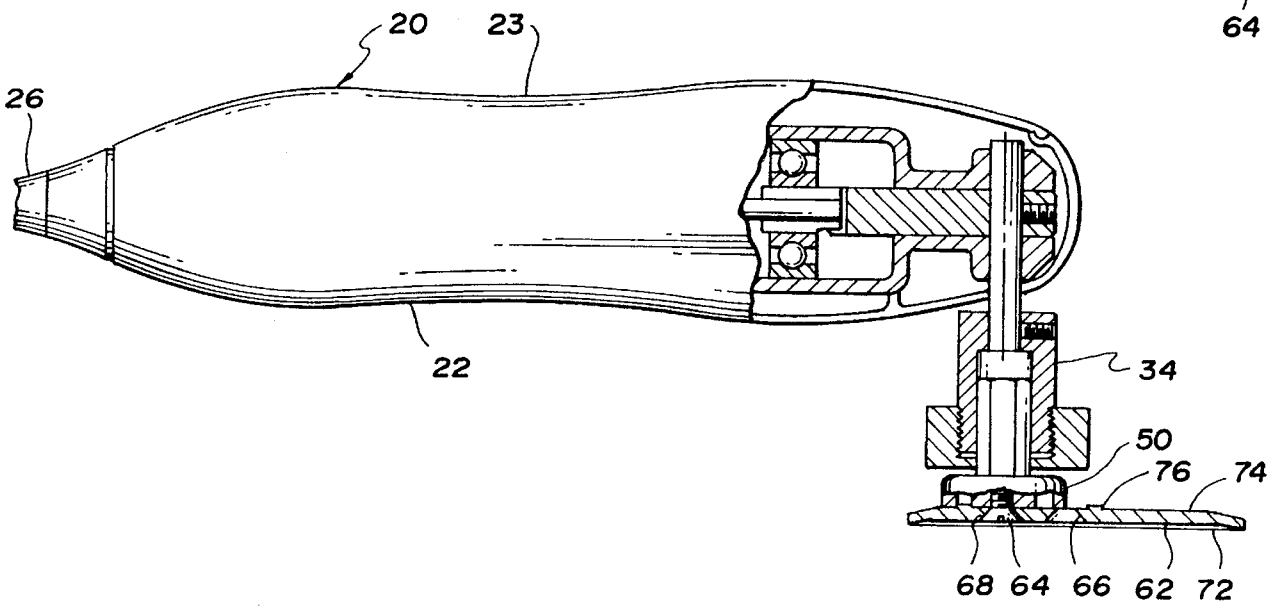
FIG. 4 is a side elevation view of an alternative embodiment of the detail sander and blade partially broken away, in accordance with the present invention.

FIG. 4 illustrates an alternative embodiment of the detail sander 20 and leg 34 that can also be employed with the blades of the present invention to allow for varying geometry in the working position.

Figure 5:
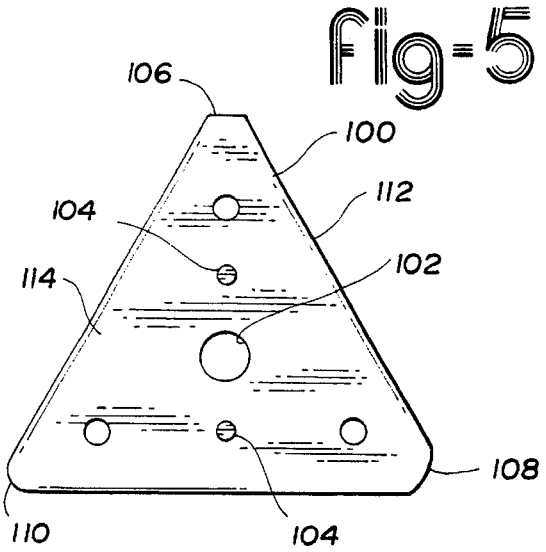
FIG. 5 is a plan view of a triangular blade in accordance with the present invention.
Figure 6:
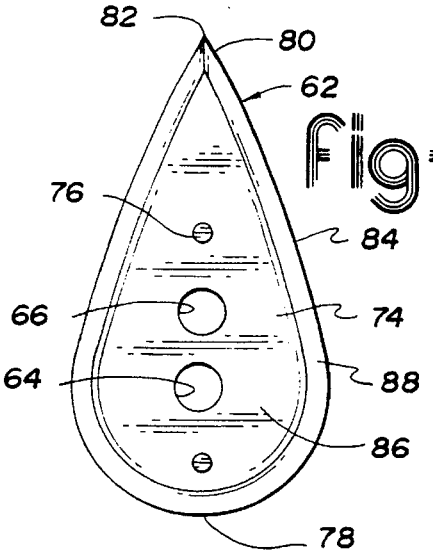
FIG. 6 is a plan view of a tear drop blade in accordance with the present invention.
Figure 10:
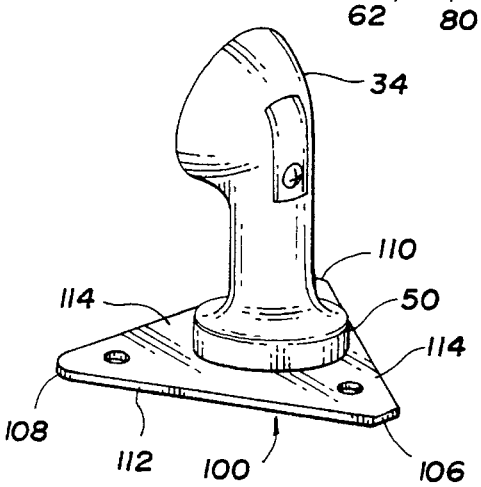
FIG. 10 is a perspective view of one possible orientation of the leg and triangular blade in accordance with the present invention.

FIGS. 5 and 10 illustrate an alternative embodiment of a variable geometry blade. A variable orientation triangular blade 100 is shown having a central mounting hole 102 aligned with two alignment bosses 104. The central mounting hole 102 aligns with the threaded mounting bore 56 on the foot 50, shown in FIG. 2. The two alignment bosses 104, then, align with one of the three pairs of alignment holes 58 in the foot 50 depending upon the orientation desired by an operator.

The blade 100 has three tip regions 106, 108, 110. The first tip region 106 is clipped flat across the tip. The second tip region 108 and third tip region 110 are rounded with the third tip region 110 having a smaller radius than the second 108. The three different shaped tip regions allow the operator of the sander 20 to choose the proper shape for a given use. Any one of the three tip regions can be oriented forward by orienting the proper alignment holes 58, shown in FIG. 2, with the alignment bosses 104. Thus, a rotation of the blade 100 120 degrees relative to the foot 50 will put a different geometry tip region in the working position. FIG. 10 shows the blade 100 mounted on the leg 34 with the first tip 106 forward.

The three tip regions 106, 108, 110 are preferably shaped such that each tip region 106, 108, 110 is normal to the top surface 114 of the blade but is 20–25 degrees from normal at the bottom surface. This allows for a more crisp edge when the blade 100 contacts the working surface.

While this blade 100 is shown with only three tip regions, a blade having more than three varying geometry tip regions can also be contemplated.

While the best mode for carrying out the invention has been described in detail, those familiar with the art to which this invention relates will recognize various alternative designs and embodiments for practicing the invention as defined by the following claims.

What is claimed:

1. A scraper blade attachment for use with a detail sander having a housing, a drive motor and an output member driven relative to the housing in an oscillatory manner about a drive axis oriented normal to a workpiece to be scraped, said scraper blade attachment comprising:

a leg member having an attachment end adapted to be affixed to a detail sander output member and a free end spaced from the attachment end; and a generally planar rigid scraper blade having a top surface adapted to be attached to the leg member free end, a peripheral edge and a bottom surface, said peripheral edge and bottom surface collectively defining a corner edge for scraping a surface of a workpiece, wherein the scraper blade is provided with an outer region adjacent the peripheral edge which is bent downwardly toward the workpiece forming an angle relative to an inner-region of the blade causing contact between the scraper blade and the planar workpiece to be confined to an area adjacent said corner edge.

2. The scraper blade attachment of claim 1 wherein the scraper blade inner-region is planar and the outer region is inclined 10° to 15° relative to the inner region.

3. The scraper blade attachment of claim 2 wherein the scraper blade peripheral edge is normal to the plane of the scraper blade inner region.

4. The scraper blade attachment of claim 1 wherein the scraper blade is removably attachable to the leg free end at a plurality of orientations.

5. The scraper blade attachment of claim 4 wherein the scraper blade is generally tear drop shaped having a pointed tip region.

6. The scraper blade attachment of claim 5 wherein the scraper blade has two separate locations which are selectively affixable to the leg with the blade tip alternatively located at two different distances from the detail sander drive axis enabling the speed of the scraper blade tip movement to be varied.

7. A scraper blade apparatus comprising:

a housing;

a drive motor oriented within the housing;

an output member driven by the drive motor relative to the housing in an oscillatory manner about a drive axis oriented normal to a workpiece to be scraped; and a scraper blade attachment including a leg member and a generally planar scraper blade, said leg member having an attachment end adapted to be affixed to the detail sander output member and a free end spaced apart from the attachment end, said free end being generally planar perpendicular to the drive axis and parallel to a workpiece to be scraped, said free end having a central aperture for receiving a fastener and a plurality of circumferentially spaced apart alignment holes formed therein, said generally planar scraper blade having a hole formed therethrough for receiving a fastener, a top surface having an upstanding boss projecting therefrom adapted to cooperate with one of the holes formed in the leg member free end so that the scraper blade may be mounted to the leg member at a plurality of orientations relative to the leg member, said scraper blade further having a peripheral edge and a bottom surface, said peripheral edge and bottom surface further defining a sharp corner edge for scraping the surface of a workpiece.

8. The scraper blade apparatus of claim 7, wherein the scraper blade is provided with a pointed tip region.

9. The scraper blade apparatus of claim 8 wherein the scraper blade has two separate attaching locations which are affixable to the leg with the blade tip located at two different locations from the detail sander drive axis enabling the speed of oscillation of the scraper blade tip to be varied.

* * * * *